US008905259B2

(12) United States Patent
Singh et al.

(10) Patent No.: US 8,905,259 B2
(45) Date of Patent: Dec. 9, 2014

(54) VENTILATED SYSTEM FOR STORING HIGH LEVEL RADIOACTIVE WASTE

(75) Inventors: Krishna P. Singh, Hobe Sound, FL (US); John D. Griffiths, Deptford, NJ (US)

(73) Assignee: Holtec International, Inc.

( * ) Notice: Subject to any disclaimer, the term of this patent is extended or adjusted under 35 U.S.C. 154(b) by 601 days.

(21) Appl. No.: 13/208,915

(22) Filed: Aug. 12, 2011

(65) Prior Publication Data

US 2012/0037632 A1 Feb. 16, 2012

Related U.S. Application Data

(60) Provisional application No. 61/373,138, filed on Aug. 12, 2010.

(51) Int. Cl.

| | |
|---|---|
| ***B65D 51/16*** | (2006.01) |
| ***G21F 9/34*** | (2006.01) |
| ***G21F 9/36*** | (2006.01) |
| ***G21F 5/005*** | (2006.01) |
| ***G21F 5/10*** | (2006.01) |

(52) U.S. Cl.

CPC .. *G21F 9/34* (2013.01); *G21F 9/36* (2013.01); *G21F 5/005* (2013.01); *G21F 5/10* (2013.01)

USPC ..... 220/367.1; 220/601; 220/202; 220/366.1; 220/565; 250/507.1; 588/1

(58) Field of Classification Search

CPC ..... G21F 5/005; G21F 9/34; G21F 5/10

USPC ..... 250/505.1, 506.1, 507.1; 588/1; 220/367.1, 913, 202, 366.1, 565, 601, 220/661, 745, 203.29, 203.27, 203.01; 141/325, 326; 137/583, 584, 587, 588, 137/589

See application file for complete search history.

(56) References Cited

U.S. PATENT DOCUMENTS

| | | | |
|---|---|---|---|
| 3,111,078 | A | 11/1963 | Breckenridge |
| 3,111,586 | A | 11/1963 | Rogers |

(Continued)

FOREIGN PATENT DOCUMENTS

| | | | |
|---|---|---|---|
| CN | 1345452 | A | 4/2002 |
| DE | 2821780 | | 11/1979 |

(Continued)

OTHER PUBLICATIONS

International Atomic Energy Agency, "Multi-purpose contanier technologies for spent fuel managemnet," Dec. 2000 (IAEA-TECDOC-1192) pp. 1-49.

(Continued)

*Primary Examiner* — Robert J Hicks
*Assistant Examiner* — Kareen Rush
(74) *Attorney, Agent, or Firm* — The Belles Group, P.C.

(57) ABSTRACT

A system for storing high level radioactive waste. In one embodiment, the invention can be a system comprising an overpack body extending along a vertical axis and having a cavity for storing high level radioactive waste, the cavity having an open top end and a floor; an overpack lid positioned atop the overpack body to enclose the open top end of the cavity; an air inlet vent for introducing cool air into the cavity, the air inlet vent comprising an annular air inlet plenum and an annular air inlet passageway, the annular air inlet plenum extending radially inward from an outer surface of the overpack body to the annular air inlet passageway, the annular air inlet passageway extending upward from the annular air inlet plenum to an opening in the floor, and an air outlet vent in the overpack lid for removing warmed air from the cavity.

20 Claims, 8 Drawing Sheets

(56) References Cited

U.S. PATENT DOCUMENTS

| | | | |
|---|---|---|---|
| 3,629,062 | A | 12/1971 | Muenchow |
| 3,739,451 | A | 6/1973 | Jacobson |
| 3,745,707 | A | 7/1973 | Herr |
| 3,755,079 | A | 8/1973 | Weinstein et al. |
| 3,765,549 | A | 10/1973 | Jones |
| 3,800,973 | A | 4/1974 | Weaver |
| 3,836,267 | A | 9/1974 | Schatz |
| 3,910,006 | A | 10/1975 | James |
| 3,917,953 | A | 11/1975 | Wodrich |
| 3,935,062 | A | 1/1976 | Keller et al. |
| 3,945,509 | A | 3/1976 | Weems |
| 3,962,587 | A | 6/1976 | Dufrane et al. |
| 3,984,942 | A | 10/1976 | Schroth |
| 4,055,508 | A | 10/1977 | Yoh et al. |
| 4,078,968 | A | 3/1978 | Golden et al. |
| 4,158,599 | A | 6/1979 | Andrews et al. |
| 4,278,892 | A | 7/1981 | Baatz et al. |
| 4,288,698 | A | 9/1981 | Baatz et al. |
| 4,336,460 | A | 6/1982 | Best et al. |
| 4,355,000 | A | 10/1982 | Lumelleau |
| 4,356,146 | A | 10/1982 | Knappe |
| 4,366,095 | A | 12/1982 | Takats et al. |
| 4,394,022 | A | 7/1983 | Gilmore |
| 4,450,134 | A | 5/1984 | Soot et al. |
| 4,498,011 | A | 2/1985 | Dyck et al. |
| 4,525,324 | A | 6/1985 | Spilker et al. |
| 4,526,344 | A | 7/1985 | Oswald et al. |
| 4,527,066 | A | 7/1985 | Dyck et al. |
| 4,532,104 | A | 7/1985 | Wearden et al. |
| 4,532,428 | A | 7/1985 | Dyck et al. |
| 4,585,611 | A | 4/1986 | Perl |
| 4,634,875 | A | 1/1987 | Kugeler et al. |
| 4,635,477 | A | 1/1987 | Simon |
| 4,649,018 | A | 3/1987 | Waltersdorf |
| 4,663,533 | A | 5/1987 | Kok et al. |
| 4,666,659 | A | 5/1987 | Lusk |
| 4,671,326 | A | 6/1987 | Wilhelm |
| 4,683,533 | A | 7/1987 | Shiozaki et al. |
| 4,690,795 | A | 9/1987 | Hardin et al. |
| 4,730,663 | A | 3/1988 | Voelkl et al. |
| 4,764,333 | A | 8/1988 | Minshall et al. |
| 4,780,269 | A | 10/1988 | Fischer et al. |
| 4,800,062 | A | 1/1989 | Craig et al. |
| 4,834,916 | A | 5/1989 | Chaudon et al. |
| 4,847,009 | A | 7/1989 | Madle et al. |
| 4,851,183 | A | 7/1989 | Hampel |
| 4,971,752 | A | 11/1990 | Parker |
| 5,102,615 | A | 4/1992 | Grande et al. |
| 5,182,076 | A | 1/1993 | de Seroux et al. |
| 5,205,966 | A | 4/1993 | Elmaleh |
| 5,267,280 | A | 11/1993 | Duquesne |
| 5,297,917 | A | 3/1994 | Freneix |
| 5,307,388 | A | 4/1994 | Inkester et al. |
| 5,319,686 | A | 6/1994 | Pizzano et al. |
| 5,387,741 | A | 2/1995 | Shuttle et al. |
| 5,469,936 | A | 11/1995 | Lauga et al. |
| 5,513,231 | A | 4/1996 | Jones et al. |
| 5,513,232 | A | 4/1996 | Jones et al. |
| 5,546,436 | A | 8/1996 | Jones et al. |
| 5,564,498 | A | 10/1996 | Bochard |
| 5,633,904 | A | 5/1997 | Gilligan et al. |
| 5,646,971 | A | 7/1997 | Howe |
| 5,661,768 | A | 8/1997 | Gilligan et al. |
| 5,753,925 | A | 5/1998 | Yamanaka et al. |
| 5,771,265 | A | 6/1998 | Montazer |
| 5,852,643 | A | 12/1998 | Copson |
| 5,862,195 | A | 1/1999 | Peterson |
| 5,898,747 | A | 4/1999 | Singh |
| 5,926,602 | A | 7/1999 | Okura |
| 6,064,710 | A | 5/2000 | Singh |
| 6,064,711 | A | 5/2000 | Copson |
| 6,074,771 | A | 6/2000 | Cubukcu et al. |
| 6,252,923 | B1 | 6/2001 | Iacovino et al. |
| 6,452,994 | B2 | 9/2002 | Pennington |
| 6,489,623 | B1 | 12/2002 | Peters et al. |
| 6,519,307 | B1 | 2/2003 | Singh et al. |
| 6,519,308 | B1 | 2/2003 | Boardman |
| 6,718,000 | B2 | 4/2004 | Singh et al. |
| 6,793,450 | B2 | 9/2004 | Singh |
| 6,853,697 | B2 | 2/2005 | Singh et al. |
| 7,068,748 | B2 | 6/2006 | Singh |
| 7,294,375 | B2 | 11/2007 | Taniuchi et al. |
| 7,330,526 | B2 * | 2/2008 | Singh ..... 376/272 |
| 7,590,213 | B1 | 9/2009 | Singh |
| 7,994,380 | B2 * | 8/2011 | Singh et al. ..... 588/16 |
| 8,067,659 | B2 * | 11/2011 | Singh et al. ..... 588/1 |
| 8,351,562 | B2 | 1/2013 | Singh |
| 2003/0144566 | A1 | 7/2003 | Singh et al. |
| 2003/0147486 | A1 | 8/2003 | Singh et al. |
| 2003/0147730 | A1 | 8/2003 | Singh et al. |
| 2003/0194042 | A1 | 10/2003 | Singh et al. |
| 2004/0109523 | A1 | 6/2004 | Singh et al. |
| 2004/0175259 | A1 | 9/2004 | Singh et al. |
| 2005/0008462 | A1 | 1/2005 | Singh et al. |
| 2005/0066541 | A1 | 3/2005 | Singh et al. |
| 2005/0207535 | A1 | 9/2005 | Alving et al. |
| 2005/0220256 | A1 | 10/2005 | Singh |
| 2005/0220257 | A1 | 10/2005 | Singh |
| 2006/0215803 | A1 | 9/2006 | Singh |
| 2006/0251201 | A1 | 11/2006 | Singh |
| 2006/0272175 | A1 | 12/2006 | Singh |
| 2006/0288607 | A1 | 12/2006 | Singh |
| 2007/0003000 | A1 | 1/2007 | Singh et al. |
| 2008/0031396 | A1 | 2/2008 | Singh et al. |
| 2008/0031397 | A1 | 2/2008 | Singh et al. |
| 2008/0056935 | A1 | 3/2008 | Singh |
| 2008/0069291 | A1 | 3/2008 | Singh et al. |
| 2008/0076953 | A1 | 3/2008 | Singh et al. |
| 2008/0084958 | A1 | 4/2008 | Singh et al. |
| 2008/0260088 | A1 | 10/2008 | Singh et al. |
| 2008/0265182 | A1 | 10/2008 | Singh et al. |
| 2008/0314570 | A1 | 12/2008 | Singh et al. |
| 2009/0069621 | A1 | 3/2009 | Singh et al. |
| 2009/0158614 | A1 | 6/2009 | Singh et al. |
| 2009/0159550 | A1 | 6/2009 | Singh et al. |
| 2009/0175404 | A1 | 7/2009 | Singh et al. |
| 2009/0198092 | A1 | 8/2009 | Singh et al. |
| 2009/0252274 | A1 | 10/2009 | Singh |
| 2010/0150297 | A1 | 6/2010 | Singh |
| 2010/0212182 | A1 | 8/2010 | Singh |
| 2010/0232563 | A1 | 9/2010 | Singh et al. |
| 2010/0272225 | A1 | 10/2010 | Singh |
| 2010/0282448 | A1 | 11/2010 | Singh et al. |
| 2010/0282451 | A1 | 11/2010 | Singh et al. |
| 2010/0284506 | A1 | 11/2010 | Singh |
| 2011/0021859 | A1 | 1/2011 | Singh |
| 2011/0033019 | A1 | 2/2011 | Rosenbaum et al. |
| 2011/0150164 | A1 | 6/2011 | Singh et al. |
| 2011/0172484 | A1 * | 7/2011 | Singh et al. ..... 588/16 |
| 2011/0255647 | A1 | 10/2011 | Singh |
| 2011/0286567 | A1 | 11/2011 | Singh et al. |
| 2012/0083644 | A1 | 4/2012 | Singh et al. |
| 2012/0142991 | A1 | 6/2012 | Singh et al. |
| 2012/0226088 | A1 | 9/2012 | Singh et al. |
| 2012/0294737 | A1 | 11/2012 | Singh et al. |
| 2012/0306172 | A1 | 12/2012 | Singh |
| 2012/0307956 | A1 | 12/2012 | Singh et al. |
| 2013/0070885 | A1 | 3/2013 | Singh et al. |
| 2013/0163710 | A1 | 6/2013 | Singh |
| 2014/0047733 | A1 | 2/2014 | Singh et al. |
| 2014/0105347 | A1 | 4/2014 | Singh et al. |

FOREIGN PATENT DOCUMENTS

| | | |
|---|---|---|
| DE | 3107158 | 1/1983 |
| DE | 3144113 | 5/1983 |
| DE | 3151475 | 5/1983 |
| DE | 3404666 | 8/1985 |
| DE | 3515871 | 11/1986 |
| DE | 195 29 357 | 8/1995 |
| EP | 0253730 | 1/1998 |
| EP | 1 061 011 | 6/2000 |
| EP | 1312674 | 5/2003 |
| FR | 2434463 | 8/1979 |

(56) References Cited

FOREIGN PATENT DOCUMENTS

| | | |
|---|---|---|
| GB | 2295484 | 5/1996 |
| GB | 2327722 | 1/1999 |
| GB | 2337722 | 1/1999 |
| JP | 59193000 | 11/1984 |
| JP | 62-165199 | 8/1987 |
| JP | 10297678 | 11/1998 |
| JP | 2001056392 | 2/2001 |
| JP | 2001141891 | 5/2001 |
| JP | 2001264463 | 9/2001 |
| JP | 2003207597 | 7/2003 |
| JP | 2003240894 | 8/2003 |
| JP | 2004233055 | 8/2004 |
| RU | 2168022 | 6/2000 |

OTHER PUBLICATIONS

U.S Department of Energy, "Conceptual Design for a Waste-Management System that Uses Multipurpose Canisters," Jan. 1994 pp. 1-14.

Federal Register Environmental Documents, "Implementation Plan for the Environmental Impact Statement for a Multi-Purpose Canister System for Management of Civilian and Naval Spent Nuclear Fuel," Aug. 30, 1995 (vol 66, No. 168) pp. 1-7.

National Conference of State Legislatures, "Developing a Multipurpose Canister System for Spent Nuclear Fuel," State Legislative Report, col. 19, No. 4 by Sis Davis et al., Mar. 1, 1994, pp. 1-4.

Energy Storm Article, "Multi-purpose canister system evaluation: A systems engineering approach," Author unavailable. Sep. 1, 1994 pp. 1-2.

Science, Society, and America's Nuclear Waste Teacher Guide , "The Role of the Multi-Purpose Canister in the Waste Management System," Author Unknown, Date unknown, 5 pgs.

USEC Inc. Article, "NAC International A Leader in Used Fuel Storage Technologies," copyright 2008, 2 pages.

Federal Register Notice, Dept of Energy, "Record of Decision for a Multi-Purpose Canister of Comparable System," vol. 64, No. 85, May 4, 1990.

Zorpette, Glen "Cannet Heat" Nuclear Power, Special Report in IEEE Spectrum, Nov. 2001, pp. 44-47.

Optimization Strategies for Cask Design and Container Loading in Long Term Spent Fuel Storage, Dec. 2006 [retrieved on Jan. 23, 2013]. Retrieved from the internet:<URL: http://www-pub.iaea.org/MTCD/publications/PDF/te_1523_web.pdf (US).

International Search Report and Written Opinion of the International Searching Authority for PCT/US2012/62470, mailed Feb. 21, 2013, WO.

* cited by examiner

VENTILATED SYSTEM FOR STORING HIGH LEVEL RADIOACTIVE WASTE

CROSS-REFERENCE TO RELATED PATENT APPLICATIONS

This application claims the benefit of U.S. Provisional Patent Application No. 61/373,138, filed Aug. 12, 2010, the entirety of which is incorporated herein by reference.

FIELD OF THE INVENTION

The present invention relates generally to systems for storing high level radioactive waste, and specifically to ventilated systems for storing high level radioactive waste that utilize natural convective cooling.

BACKGROUND OF THE INVENTION

The storage, handling, and transfer of high level waste, (hereinafter, "HLW") such as spent nuclear fuel (hereinafter, "SNF"), requires special care and procedural safeguards. For example, in the operation of nuclear reactors, it is customary to remove fuel assemblies after their energy has been depleted down to a predetermined level. Upon removal, this spent nuclear fuel is still highly radioactive and produces considerable heat, requiring that great care be taken in its packaging, transporting, and storing. In order to protect the environment from radiation exposure, spent nuclear fuel is first placed in a canister. The loaded canister is then transported and stored in large cylindrical containers called casks. A transfer cask is used to transport spent nuclear fuel from location to location while a storage cask is used to store spent nuclear fuel for a determined period of time.

In a typical nuclear power plant, an open empty canister is first placed in an open transfer cask. The transfer cask and empty canister are then submerged in a pool of water. Spent nuclear fuel is loaded into the canister while the canister and transfer cask remain submerged in the pool of water. Once fully loaded with spent nuclear fuel, a lid is typically placed atop the canister while in the pool. The transfer cask and canister are then removed from the pool of water, the lid of the canister is welded thereon and a lid is installed on the transfer cask. The canister is then properly dewatered and tilled with inert gas. The transfer cask (which is holding the loaded canister) is then transported to a location where a storage cask is located. The loaded canister is then transferred from the transfer cask to the storage cask for long term storage. During transfer from the transfer cask to the storage cask, it is imperative that the loaded canister is not exposed to the environment.

One type of storage cask is a ventilated vertical overpack ("VVO"). A VVO is a massive structure made principally from steel and concrete and is used to store a canister loaded with spent nuclear fuel (or other HLW). VVOs stand above ground and are typically cylindrical in shape and extremely heavy, weighing over 150 tons and often having a height greater than 16 feet. VVOs typically have a flat bottom, a cylindrical body having a cavity to receive a canister of spent nuclear fuel, and a removable top lid.

In using a VVO to store spent nuclear fuel, a canister loaded with spent nuclear fuel is placed in the cavity of the cylindrical body of the VVO. Because the spent nuclear fuel is still producing a considerable amount of heat when it is placed in the VVO for storage, it is necessary that this heat energy have a means to escape from the VVO cavity. This heat energy is removed from the outside surface of the canister by ventilating the VVO cavity. In ventilating the VVO cavity, cool air enters the VVO chamber through bottom ventilation ducts, flows upward past the loaded canister, and exits the VVO at an elevated temperature through top ventilation ducts. The bottom and top ventilation ducts of existing VVOs are located near the bottom and top of the VVO's cylindrical body respectively.

While it is necessary that the VVO cavity be vented so that heat can escape from the canister, it is also imperative that the VVO provide adequate radiation shielding and that the spent nuclear fuel not be directly exposed to the external environment. The inlet duct located near the bottom of the overpack is a particularly vulnerable source of radiation exposure to security and surveillance personnel who, in order to monitor the loaded overpacks, must place themselves in close vicinity of the ducts for short durations. Thus, a need exists for a VVO system for the storage of high level radioactive waste that has an inlet duct that reduces the likelihood of radiation exposure while providing extreme radiation blockage of both gamma and neutron radiation emanating from the high level radioactive waste.

BRIEF SUMMARY OF THE INVENTION

These, and other drawbacks, are remedied by the present invention.

In one embodiment, the invention can be a system for storing high level radioactive waste comprising: an overpack body extending along a vertical axis and having a cavity for storing high level radioactive waste, the cavity having an open top end and a floor; an overpack lid positioned atop the overpack body to enclose the open top end of the cavity; an air inlet vent for introducing cool air into the cavity, the air inlet vent comprising an annular air inlet plenum and an annular air inlet passageway, the annular air inlet plenum extending radially inward from an outer surface of the overpack body to the annular air inlet passageway, the annular air inlet passageway extending upward from the annular air inlet plenum to an opening in the floor; and an air outlet vent in the overpack lid for removing warmed air from the cavity.

In another embodiment, the invention can be a system for storing high level radioactive waste comprising: an overpack body extending along a vertical axis and having a cavity for storing high level radioactive waste, the cavity having an open top end and a floor, the overpack body comprising an air inlet vent for introducing cool air into a bottom portion of the cavity; an overpack lid positioned atop the overpack body to enclose the open top end of the cavity, the overpack lid comprising an air outlet vent for removing warmed air from the cavity; and the air inlet vent configured so that aerodynamic performance of the air inlet vent is substantially independent of an angular direction of a horizontal component of an airstream applied to the outer surface of the overpack body.

In still another embodiment, the invention can be a system for storing high level radioactive waste comprising: an overpack body extending along a vertical axis and having a cavity for storing high level radioactive waste, the cavity having an open top end and a floor, the overpack body comprising an air inlet vent for introducing cool air into a bottom portion of the cavity; an overpack lid positioned atop the overpack body to enclose the open top end of the cavity, the overpack lid comprising an air outlet vent for removing warmed air from a top portion of the cavity; and the air inlet vent comprising a first section extending from an outer surface of the overpack body to a first radial distance from the vertical axis and a second section extending from the first radial distance to an opening in the floor at a second radial distance from the vertical axis, the second radial distance being greater than the first radial distance.

In an even further embodiment, the invention can be a system for storing high level radioactive waste comprising: an overpack body extending along a vertical axis and having a cavity for storing high level radioactive waste, the cavity having an open top end and a floor, the overpack body comprising an air inlet vent for introducing cool air into a bottom portion of the cavity, the air inlet vent being substantially axisymmetric; and an overpack lid positioned atop the overpack body to enclose the open top end of the cavity, the overpack lid comprising an air outlet vent for removing warmed air from the cavity, the air outlet vent being substantially axisymmetric.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE DRAWINGS

Figure 1:
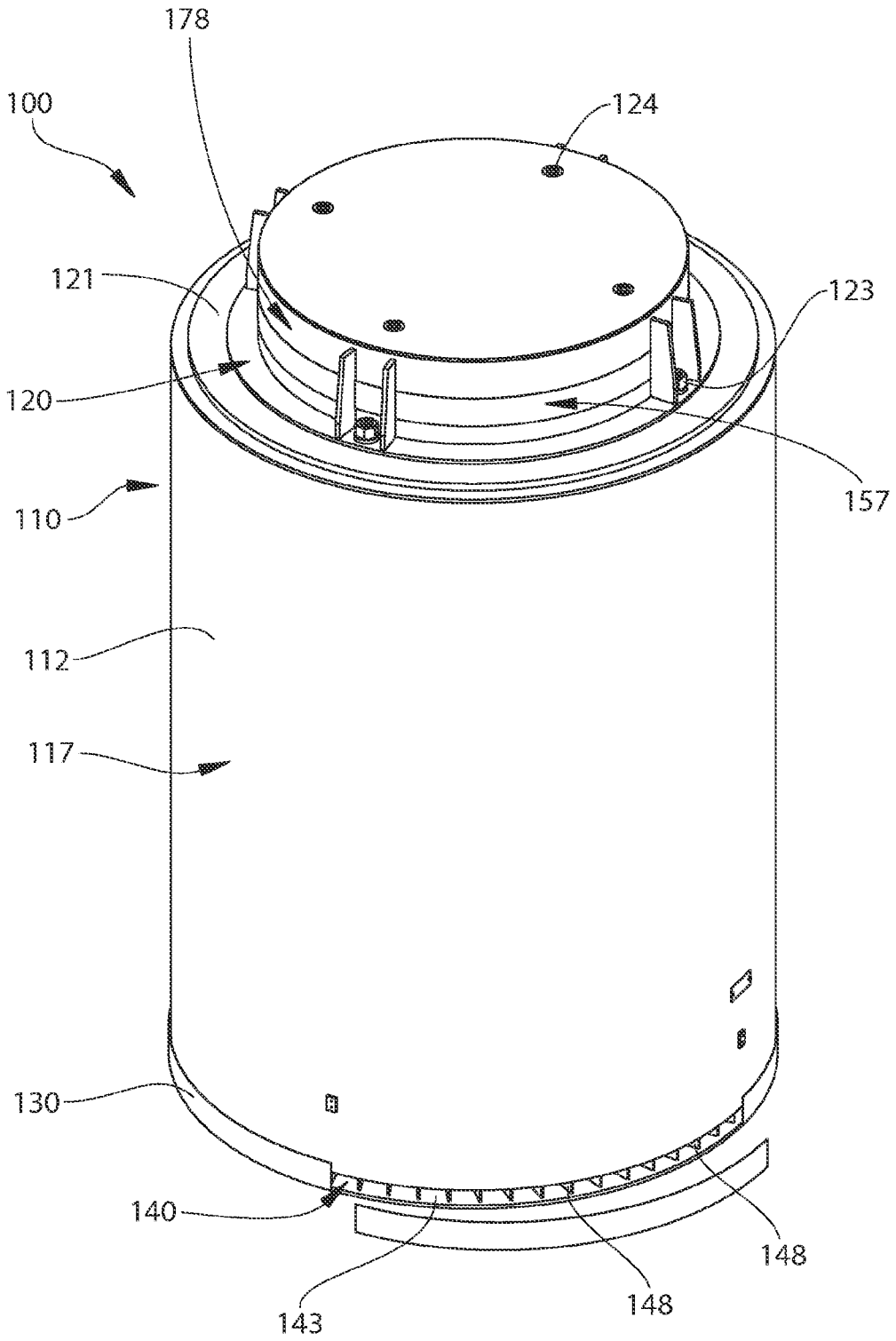
FIG. 1 is an isometric view of a vertical ventilated overpack in accordance with an embodiment of the present invention.
Figure 2:
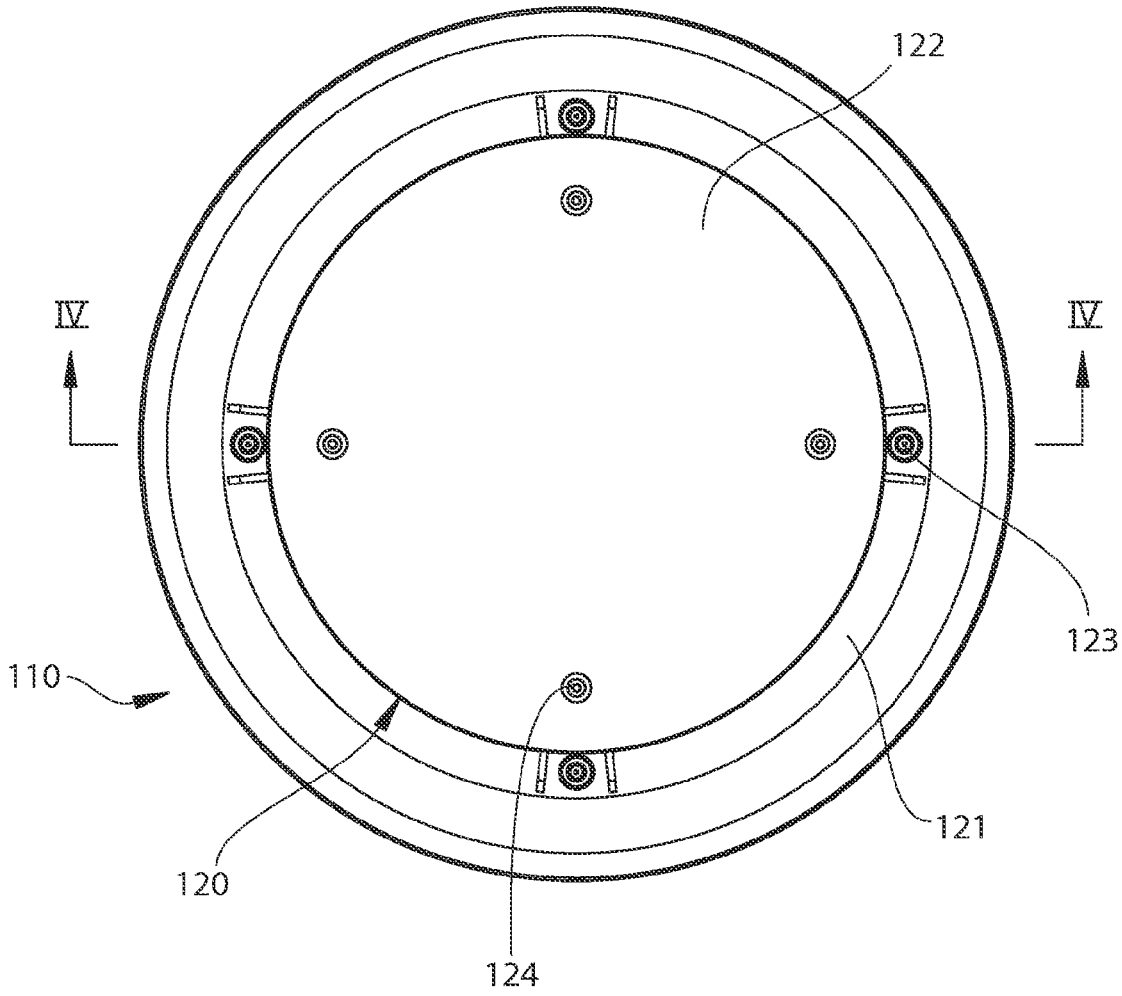
FIG. 2 is a top view of the vertical ventilated overpack of FIG. 1.
Figure 3:
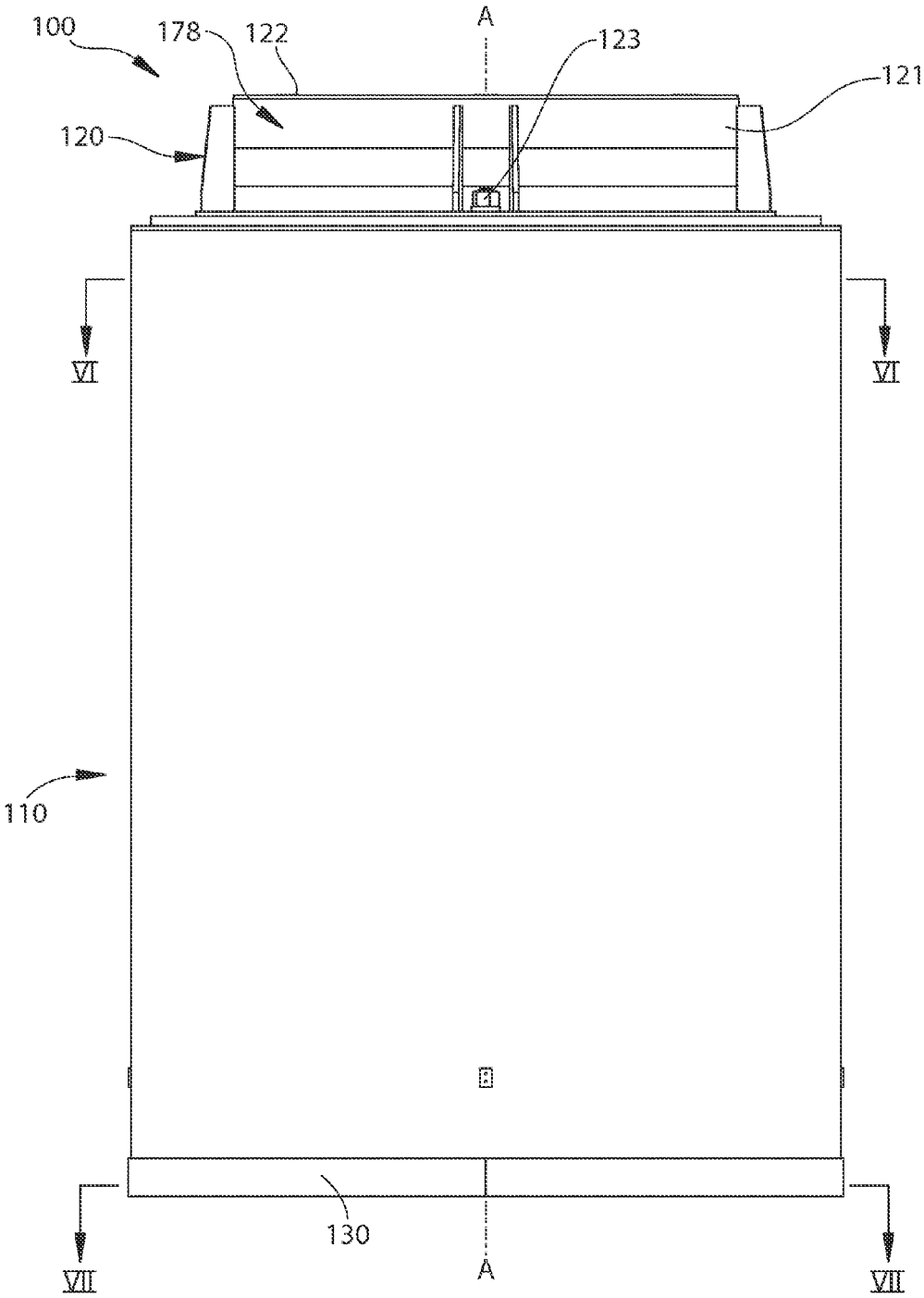
FIG. 3 is a front view of the vertical ventilated overpack of FIG. 1.

The following description of the preferred embodiment(s) is merely exemplary in nature and is in no way intended to limit the invention, its application, or uses.

Referring to FIGS. 1-4 concurrently, a system for storing high level radioactive waste will be described in accordance with an embodiment of the present invention. The system can be considered a VVO 100. The VVO 100 is a vertical, ventilated dry spent fuel storage system that is fully compatible with 100 ton and 125 ton transfer casks for spent fuel canister operations. Of course, the VVO 100 can be modified/designed to be compatible with any size or style transfer cask. The VVO 100 is designed to accept spent fuel canisters for storage. All spent fuel canister types engineered for storage in free-standing and anchored overpack models can be stored in VVO 100.

As used herein the term "canister" broadly includes any spent fuel containment apparatus, including, without limitation, multi-purpose canisters and thermally conductive casks. For example, in some areas of the world, spent fuel is transferred and stored in metal casks having a honeycomb grid-work/basket built directly into the metal cask. Such casks and similar containment apparatus qualify as canisters, as that term is used herein, and can be used in conjunction with VVO 100 as discussed below.

In certain embodiments, the VVO 100 is a substantially cylindrical containment unit having a vertical axis A-A and a horizontal cross-sectional profile that is substantially circular in shape. Of course, it should be understood that the invention is not limited to cylinders having circular horizontal cross sectional profiles but may also include containers having cross-sectional profiles that are, for example, rectangular, ovoid or other polygon forms. While the VVO 100 is particularly useful for use in conjunction with storing and/or transporting SNF assemblies, the invention is in no way limited by the type of waste to be stored. The VVO cask 100 can be used to transport and/or store almost any type of HLW. However, the VVO 100 is particularly suited for the transport, storage and/or cooling of radioactive materials that have a high residual heat load and that produce neutron and gamma radiation, such as SNF. This is because the VVO 100 is designed to both provide extreme radiation blockage of gamma and neutron radiation and facilitate a convective/no force cooling of any canister contained therein.

The VVO 100 of the present invention generally comprises an overpack body 110 for storing high level radioactive waste and a removable overpack lid 120 that is positioned atop the overpack body 110. The overpack body 110 extends along the vertical axis A-A. The overpack lid 120 generally comprises a primary lid 121 and a secondary lid 122. The primary lid 121 is secured to the overpack body 110 by bolts 123 that restrain separation of the primary lid 121 of the overpack lid 120 from the overpack body 110 in case of a tip over situation. Moreover, the secondary lid 122 is secured to the primary lid 121 by bolts 124. The overpack lid 120 is a steel/concrete structure that is equipped with an axisymmetric air outlet vent or passageway 145 for the ventilation/removal of air as will be discussed in more detail below. An annular opening 157 is formed in an outer sidewall surface 178 of the overpack lid 120 that forms a passageway from the air outlet vent 145 to the external environment. More specifically, the annular opening 157 is a 360° opening in the outer sidewall surface 178 of the overpack lid 120. The overpack lid 120 has a quick connect/disconnect joint to minimize human activity for its installation or removal. In certain embodiments, the overpack lid 120 may weigh in excess of 15 tons.

The VVO 100 further comprises shock absorber or crush tubes 102 in its top region. The shock absorber tubes 102 are arranged at suitable angular spacings to serve as a sacrificial crush material if, for any reason, the VVO 100 were to tip over. The shock absorber tubes 102 also facilitate guiding and positioning of a canister within a cavity 111 of the VVO 100 in a substantially concentric disposition with respect to the VVO 100.

Figure 4:
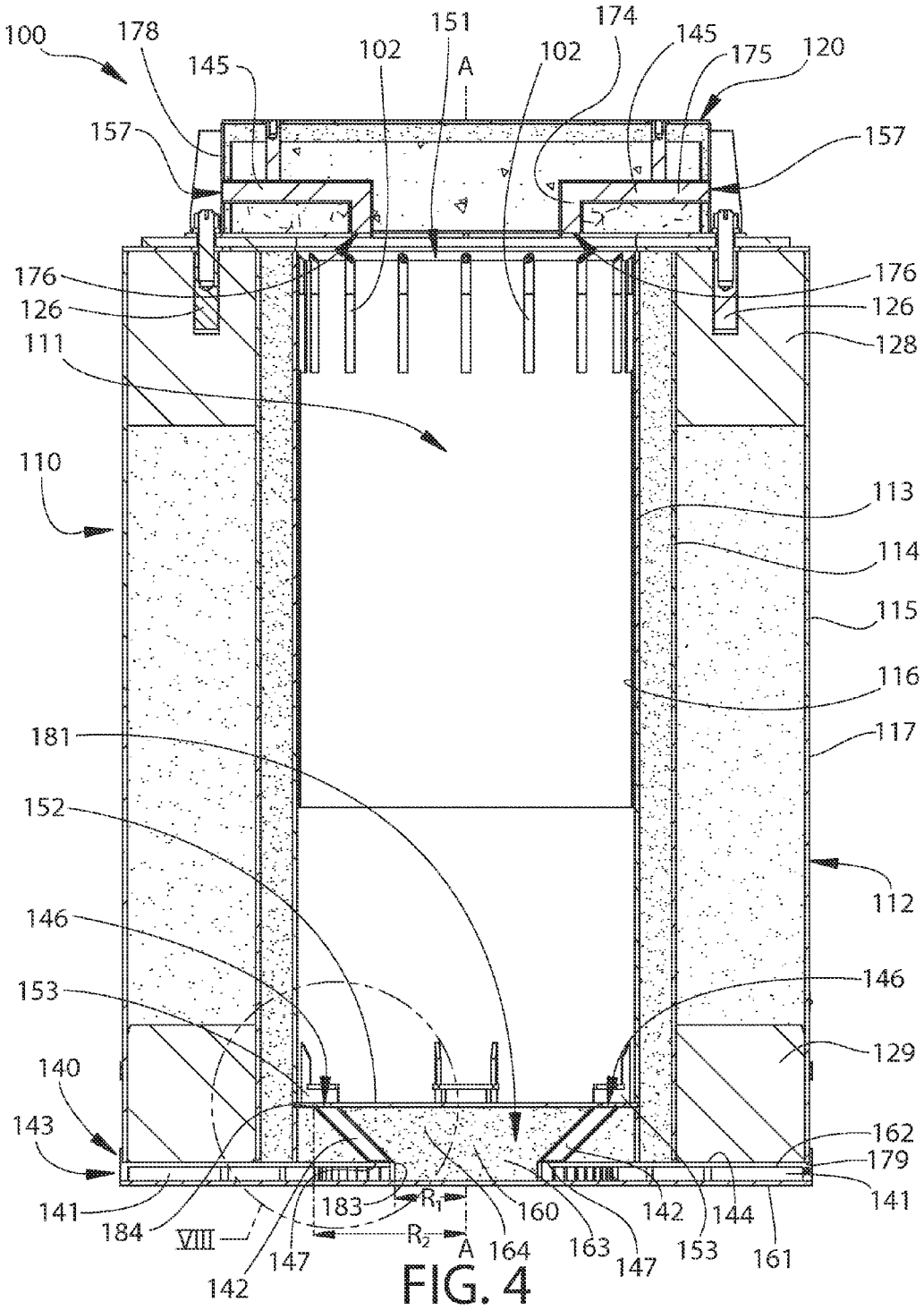
FIG. 4 is a cross-sectional view of the vertical ventilated overpack taken along line IV-IV of FIG. 2.
Figure 5:
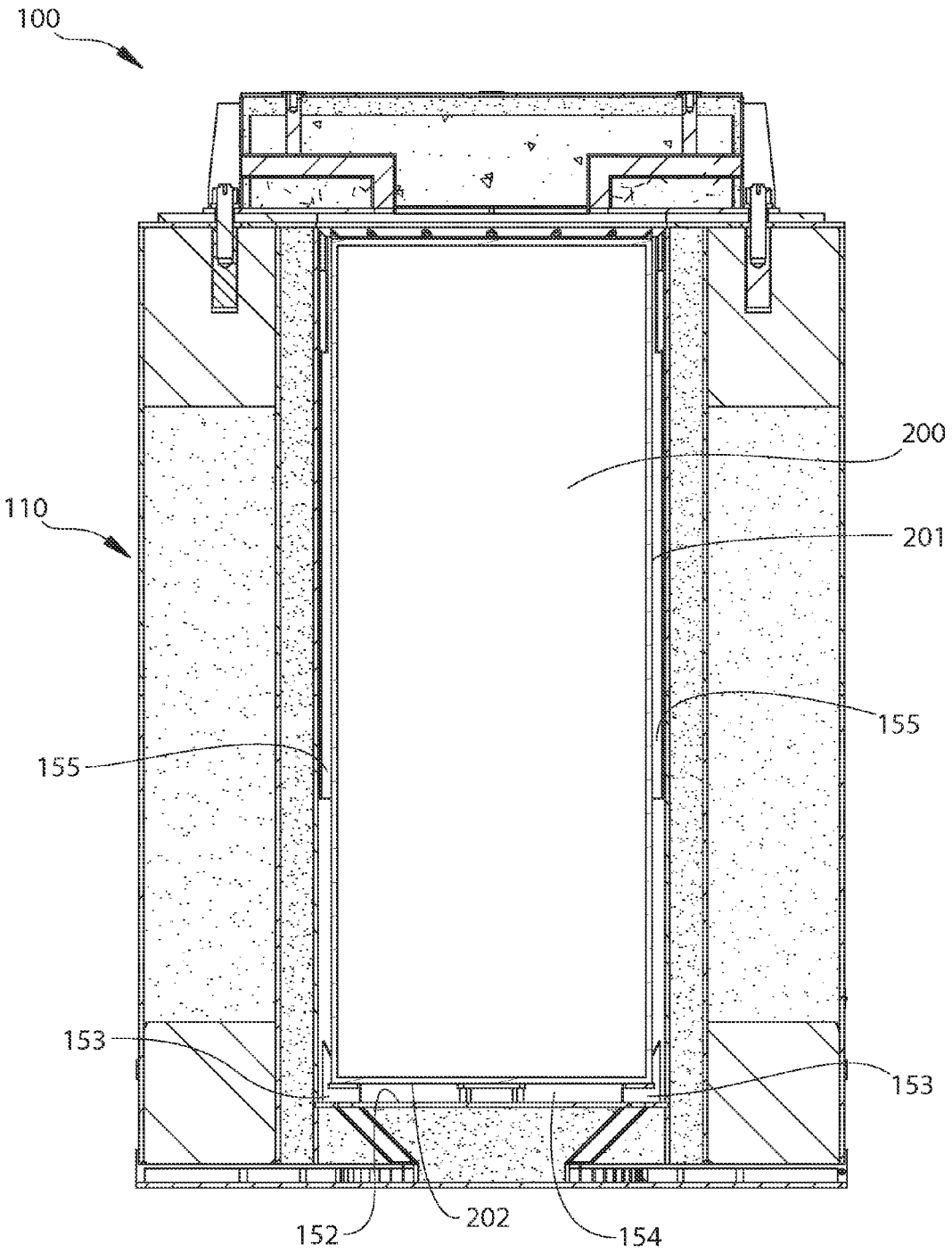
FIG. 5 is the cross-sectional view of the vertical ventilated overpack of FIG. 4 with a canister positioned within the cavity.
Figure 6:
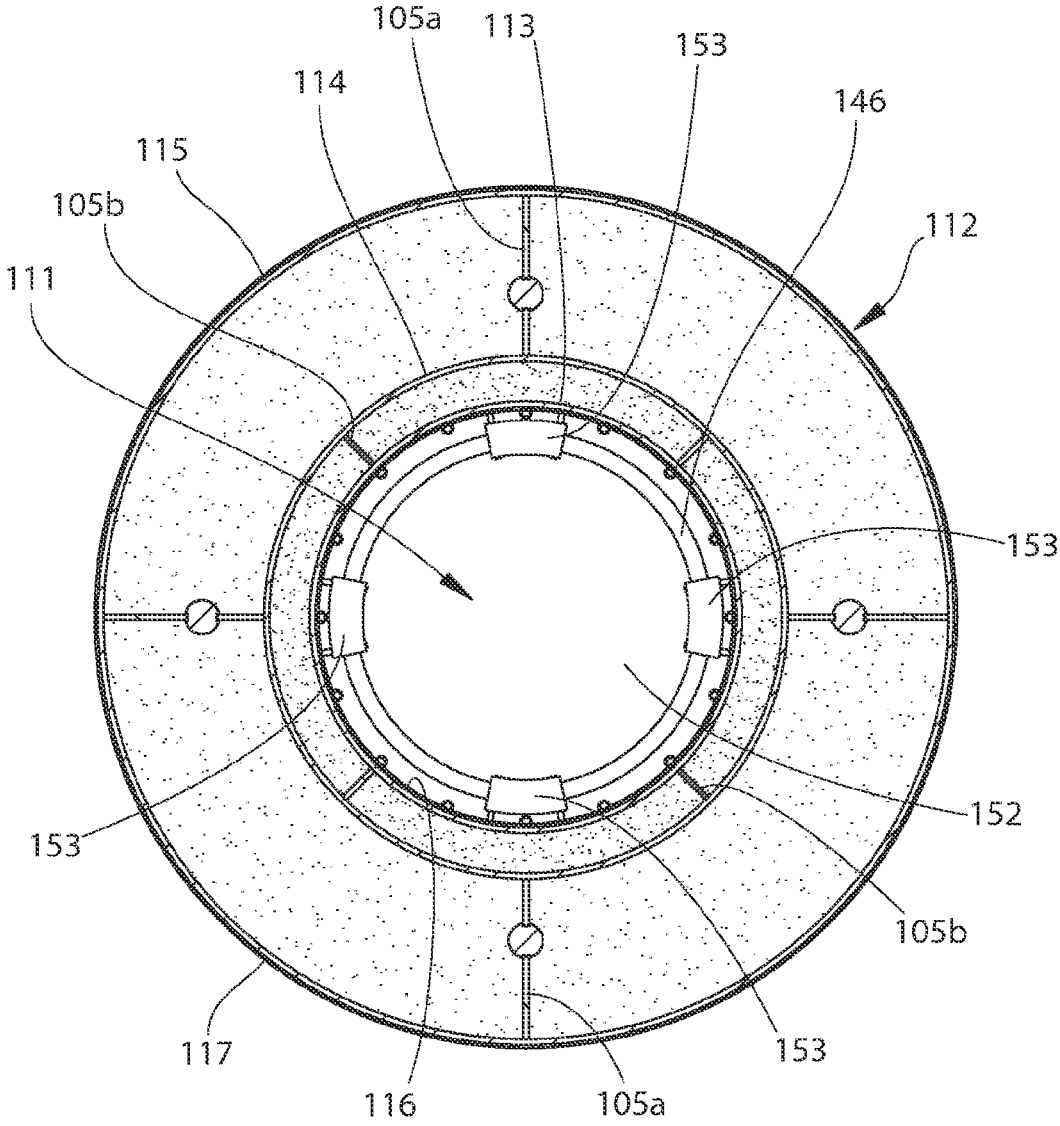
FIG. 6 is a cross-sectional view of the vertical ventilated overpack taken along line VI-VI of FIG. 3.
Figure 7:
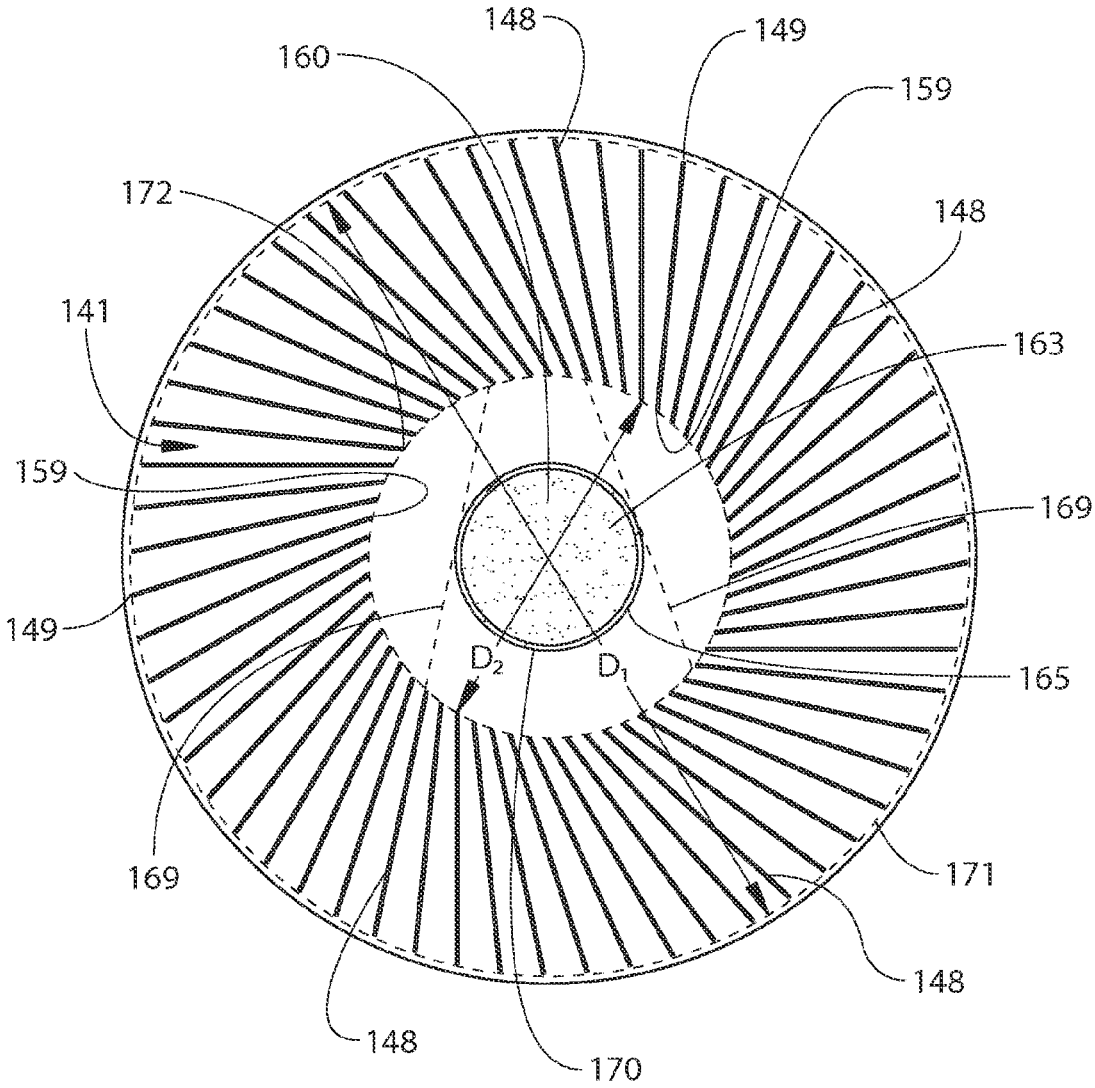
FIG. 7 is a cross-sectional view of the vertical ventilated overpack taken along line VII-VII of FIG. 3.
Figure 8:
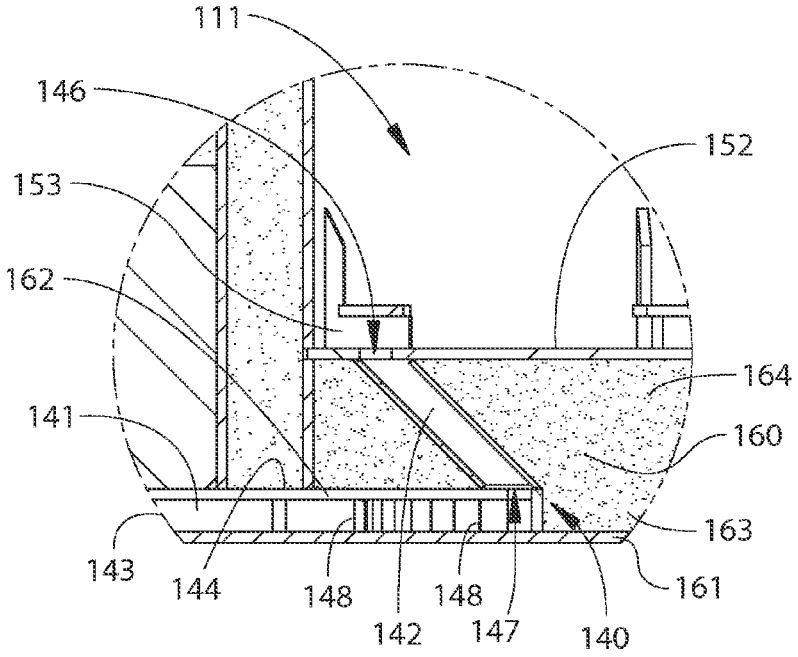
FIG. 8 is a close-up view of a portion of the vertical ventilated overpack illustrated in FIG. 4.

Referring to FIGS. 1, 4 and 6 concurrently, the overpack body 110 comprises a cylindrical wall 112, a bottom enclosure plate 130 and the overpack lid 120 described above. The cylindrical wall 112 has an inner shell 113, an intermediate shell 114 and an outer shell 115. In the exemplified embodiment, each of the inner, intermediate and outer shells 113, 114, 115 are formed of one-inch thick steel. Of course, the invention is not to be so limited and in other embodiments the inner, intermediate and outer shells 113, 114, 115 can be formed of metals other than steel and can be greater or less than one-inch in thickness. The inner shell 113 has an inner surface 116 that defines an internal cavity 111 for containing a hermetically sealed canister that contains high level radioactive waste (FIG. 5). The inner surface 116 of the inner shell 113 also forms the inner wall surface of the overpack body 110. Furthermore, the outer shell 115 has an outer surface 117. The outer surface 117 of the outer shell 115 also forms the outer sidewall surface of the overpack body 110.

In the exemplified embodiment, the inner, intermediate and outer shells 113, 114, 115 are concentric shells that are rendered into a monolithic weldment by a plurality of connector plates 105*a*, 105*b*. The inner shell 113 is spaced from the intermediate shell 114 by connector plates 105*a* and the intermediate shell 114 is spaced from the outer shell 115 by connector plates 105*b*. Of course, in certain other embodiments the connector plates 105*a*, 105*b* can be altogether omitted. The space between the inner shell 113 and the intermediate shell 114 is intended for placement of a neutron shielding material. For example, in certain embodiments the neutron radiation shielding material is a hydrogen-rich material, such as, for example, Holtite, water or any other material that is rich in hydrogen and a Boron-10 isotope. In certain embodiments, there is approximately seven inches of Holtite filling the space between the inner and intermediate shells 113, 114. Thus, the space between the inner and intermediate shells 113, 114 serves to prevent neutron radiation from passing through the VVO 100 and into the external environment.

An axially intermediate portion of the space between the intermediate shell 114 and the outer shell 115 is filled with a heavy shielding concrete to capture and prevent the escape of both gamma and neutron radiation. The density of the concrete is preferably maximized to increase the radiation absorption characteristics of the VVO 100. In certain embodiments, there is approximately twenty-eight inches of concrete filling the intermediate portion of the space between the intermediate and outer shells 114, 115. In some embodiments, steel plates are placed within the concrete to serve as a supplemental radiation curtain. There are no lateral penetrations in the multi-shell weldment that may provide a streaming path for the radiation issuing from the high level radioactive waste.

The top and bottom portions of the space between the intermediate and outer shells 114, 115 (both above and below the concrete) are top and bottom forgings 128, 129 in the form of thick annular rings made of a metal material, such as steel. The top forging 128 comprises machine threaded holes 126 that are sized and configured to receive the bolts 123 of the primary lid 121 therein during attachment of the overpack lid 120 to the overpack body 110.

As noted above, the inner surface 116 of the inner shell 113 defines the cavity 111. In the exemplified embodiment, the cavity 111 is cylindrical in shape. However, the cavity 111 is not particularly limited to any specific size, shape, and/or depth, and the cavity 111 can be designed to receive and store almost any shape of canister. In certain embodiments, the cavity 111 is sized and shaped so that it can accommodate a canister of spent nuclear fuel or other HLW. More specifically, the cavity 111 has a horizontal cross-section that can accommodate no more than one canister. Even more specifically, it is desirable that the size and shape of the cavity 111 be designed so that when a spent fuel canister is positioned in the cavity 111 for storage, a small clearance exists between outer side walls of the canister and the inner surface 116 of the inner shell 113, as will be discussed in more detail below with reference to FIG. 5.

Referring to FIGS. 4 and 5 concurrently, the present invention will be further described. The cavity 111 comprises a floor 152 and an open top end 151 that is enclosed by the overpack lid 120 as has been described herein above. A plurality of support blocks 153 are disposed on the floor 152 of the cavity 111 to support a canister 200 contained within the cavity 111 above the floor 152. In the exemplified embodiment, four support blocks 153 are illustrated (see FIG. 6). However, more or less than four support blocks 153 can be used in alternate embodiments. Each of the support blocks 153 is a low profile lug that is welded to the inner surface 116 of the inner shell 113 and/or to the floor 152. In the exemplified embodiment, the canister 200 is a hermetically sealed canister for containing the high level radioactive waste. When the canister 200 is positioned within the cavity 111, it rests atop the support blocks 153 so that a space 154 exists between a bottom 202 of the canister 200 and the floor 152. The space 154 is a bottom plenum that serves as the recipient of ventilation air flowing up from an inlet vent as will be described below.

Furthermore, when the canister 200 is positioned within the cavity 111, an annular gap 155 exists between the inner surface 116 of the inner shell 113 (i.e., the inner wall surface of the overpack body 110) and an outer surface 201 of the canister 200. The annular gap 155 is an uninterrupted and continuous gap that circumferentially surrounds the canister 200. In other words, the canister 200 is concentrically spaced apart from the inner shell 113, thereby creating the annular gap 155. As described in more detail below, the annular gap 155 forms an annular air flow passageway between an annular air inlet passageway 142 and the air outlet vent 145.

The VVO 100 is configured to achieve a cyclical thermosiphon flow of gas (i.e., air) within the cavity 111 when spent nuclear fuel emanating heat (i.e., the canister 200) is contained therein. In other words, the VVO 100 achieves a ventilated flow by virtue of a chimney effect. Such cyclical thermosiphon flow of the gas further enhances the transmission of heat to the environment external to the VVO 100. The thermosiphon flow of gas is achieved as a result of an air inlet vent 140 that introduces cool air into the bottom of the cavity 111 of the overpack body 110 from the external environment and an air outlet vent 145 for removing warmed air from the cavity 111. Thus, as a result of thermosiphon flow, cool external air can enter into the space 154 of the cavity 111 between the bottom 202 of the canister 200 and the floor 152 via the air inlet vent 140, flow upward through the cavity 111 within the annular gap 155 between the canister 200 and the inner surface 116 of the inner shell 113, and flow back out into the external environment as warmed air via the air outlet vent 145. The newly entered air will warm due to proximity to the extremely hot canister 200, which will cause the natural thermosiphon flow process to take place whereby the heated air will continually flow upwardly as fresh cool air continues to enter into the cavity 111 via the air inlet vent 140. Thus, the air inlet vent 140 provides a passageway that facilitates cool air entering the cavity 111 from the external environment and the air outlet vent 145 provides a passageway that facilitates warm air exiting the cavity back to the external environment.

In the exemplified embodiment, the air outlet vent 145 is formed into the overpack lid 120. The air outlet vent 145 provides an annular passageway from a top portion of the cavity 111 to the external environment when the overpack lid 120 is positioned atop the overpack body 110 thereby enclosing the top end 151 of the cavity 111. Specifically, the air outlet vent 145 has a vertical section 174 that extends from the cavity 111 upwardly into the overpack lid 120 in the vertical direction (i.e., the direction of the vertical axis A-A) and a horizontal section 175 that extends from the vertical section 174 to the annular opening 157 in the horizontal direction (i.e., the direction transverse to the vertical axis A-A). More specifically, the vertical section 174 of the air outlet vent 145 extends from an annular opening 176 in a bottom surface 177 of the overpack lid 120 and the horizontal section 175 extends from the vertical section 174 to the annular opening 157 in the outer sidewall surface 178 of the overpack lid 120. As described above, the annular opening 157 is a circumferential opening that extends around the entirety of the overpack lid 120 in a continuous and uninterrupted manner and circumferentially surrounds the vertical axis A-A.

The overpack body 110 additionally comprises a bottom block 160 disposed within the cylindrical wall 112, and more specifically within the inner shell 113 of the cylindrical wall 112, and a base structure at a bottom end 179 of the cylindrical wall 112. The base structure comprises a base plate 161 and an annular plate 162. The air inlet vent 140 is formed directly into the bottom block 160, which is a thick sandwich of steel and concrete. The bottom block 160 is positioned below the floor 152 of the cavity 111. More specifically, the bottom block 160 extends between the floor 152 of the cavity 111 and the base plate 161, which forms the bottom end of the VVO 100. The bottom block 160 has a columnar portion 163 and a horizontal portion 164.

The annular plate 162 is a donut-shaped plate having a central hole 181. The annular plate 162 is axially spaced from the base plate 161, thereby creating a space or gap in between the annular plate 162 and the base plate 161. Moreover, the annular plate 162 extends from the outer surface 117 of the overpack body 110 inwardly towards the vertical axis A-A a radial distance that is less than the radius of the overpack body 110. More specifically, the annular plate 162 extends from the outer surface 117 of the overpack body 110 to the columnar portion 163 of the bottom block 160. Thought of another way, the columnar portion 163 of the bottom block 160 extends through the central hole 181 of the annular plate 162 and rests atop the base plate 161.

Referring to FIGS. 1, 4, 6 and 8 concurrently, the air inlet vent 140 will be described in more detail. In the exemplified embodiment, the air inlet vent 140 is formed into the bottom closure plate 130 and extends into the bottom block 160 and comprises an annular air inlet plenum 141 and an annular air inlet passageway 142. The annular air inlet plenum 141 is formed in the space/gap between the annular plate 162 and the base plate 161. Thus, the annular air inlet plenum 141 is substantially horizontal and extends radially inward from the outer surface 117 of the overpack body 110. More specifically, the annular air inlet plenum 141 extends horizontally from the outer surface 117 of the overpack body 110 at an axial height below the floor 152 of the cavity 111. An opening 143 is formed in the outer surface 117 of the overpack body 110 that forms a passageway from the external environment to the annular air inlet plenum 141 to enable cool air to enter into the annular air inlet plenum 141 from the external environment as has been described above. The opening 143 circumferentially surrounds the vertical axis A-A around the entirety of the outer surface 117 of the overpack body 110 in an uninterrupted and continuous manner. In other words, the opening 143 is a substantially 360° opening in the outer surface 117 of the overpack body 110.

The annular air inlet passageway 142 extends upward from a top surface 144 of the annular air inlet plenum 141 to the floor 152 of the cavity 111. More specifically, the annular air inlet passageway 142 extends upwardly from an opening 147 in the top surface 144 of the annular air inlet plenum 141 to an opening 146 in the floor 152. The annular air inlet passageway 142 is wholly formed within the bottom block 160. The opening 147 in the top surface 144 of the annular air inlet plenum 141 is proximate an end of the annular air inlet plenum opposite the opening 143 in the outer surface 117 of the overpack body 110. The opening 146 in the floor 152 is an annular opening that extends 360° around the floor 152.

The annular air inlet plenum 141 circumferentially surrounds the vertical axis A-A. In the exemplified embodiment, the annular air inlet passageway 142 also circumferentially surrounds the vertical axis A-A and has an inverted truncated cone shape. Thus, the annular air inlet passageway 142 extends upward from the air inlet plenum 141 to the opening 146 in the floor 152 of the cavity 111 at an oblique angle relative to the vertical axis A-A. Thought of another way, the annular inlet passageway 142 extends from the air inlet plenum 141 at a first end 183 to the floor 152 at a second end 184. The first end 183 is located a first radial distance $R_1$ from the vertical axis A-A and the second end 184 is located a second radial distance $R_2$ from the vertical axis A-A. The second radial distance $R_2$ is greater than the first radial distance $R_1$. Of course, the invention is not to be so limited and in certain other embodiments the annular air inlet passageway 142 can take on other shapes as desired.

Referring to FIGS. 1, 4, 7 and 8 concurrently, the annular air inlet plenum 141 will be further described. The annular air inlet plenum 141 comprises a plurality of plates 148 therein. Each of the plates 148 extends from a first end 149 to a second end 159. The first ends 149 of the plates 148 are proximate the outer surface 117 of the overpack body 110 and the second ends 159 of the plates 148 are proximate the columnar portion 163 of the bottom block 160. A line connecting the first ends 149 of the plates 148 forms a first reference circle 171 having a diameter $D_1$ and a line connecting the second ends 159 of the plates 148 forms a second reference circle 172 having a diameter $D_2$, wherein the first diameter $D_1$ is greater than the second diameter $D_2$.

Each of the plates 148 in the annular air inlet plenum 141 extend along a reference line 169 that is tangent to a third reference circle 170. Although the reference line 169 is only illustrated with regard to two of the plates 148, it should be understood that each of the plates has a reference line that is tangent to the third reference circle 170. The circumference of the third reference circle 170 is formed by an outer surface 165 of the columnar portion 163 of the bottom block 160. The third reference circle 170 has a center point that is coincident with the vertical axis A-A. In the exemplified embodiment, the plates 148 are thin steel plates that facilitate transferring the weight of the VVO 100 to the base plate 161 and also provide a means to scatter and absorb any errant gamma radiation that may attempt to exit the air inlet plenum. Furthermore, in the exemplified embodiment sixty plates 148 are illustrated. However, the invention is not to be so limited and in certain other embodiments more or less than sixty plates 148 may be disposed within the annular air inlet plenum 141.

Due to the axisymmetric configuration of the air inlet plenum 141, the annular air inlet vent 140 is configured so that aerodynamic performance of the air inlet vent 140 is independent of an angular direction of a horizontal component of an air-stream applied to the outer surface 117 of the overpack body 101. Similarly, due to the axisymmetric configuration of the air outlet vent 145, the air outlet vent 145 is configured so that the aerodynamic performance of the air outlet vent 145 is independent of an angular direction of a horizontal component of an air-stream applied to the outer surface 117 of the overpack body 110.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A system for storing high level radioactive waste comprising:

an overpack body extending along a vertical axis and having a cavity for storing high level radioactive waste, the cavity having an open top end and a floor;

an overpack lid positioned atop the overpack body to enclose the open top end of the cavity;

an air inlet vent for introducing cool air into the cavity, the air inlet vent comprising an annular air inlet plenum and an annular air inlet passageway, the annular air inlet plenum extending radially inward from an outer surface of the overpack body to the annular air inlet passageway, the annular air inlet passageway extending upward from the annular air inlet plenum to an opening in the floor; and an air outlet vent in the overpack lid for removing warmed air from the cavity.

2. The system of claim 1 wherein the annular air inlet passageway has an inverted truncated cone-shape.

3. The system of claim 1 wherein the annular air inlet plenum circumferentially surrounds the axis.

4. The system of claim 1 wherein the annular air inlet plenum extends horizontally from the outer surface of the overpack body at an axial height below the floor, the annular air inlet passageway extending upward from the air inlet plenum to the opening in the floor at an oblique angle to the vertical axis.

5. The system of claim 1 further comprising a plurality of plates disposed within the annular air inlet plenum, each of the plates extending along a reference line that is tangent to a first reference circle having a center point coincident with the vertical axis.

6. The system of claim 1 wherein the annular air inlet plenum extends from a substantially 360° opening in the outer surface of the overpack body.

7. The system of claim 1 wherein the air inlet vent is configured so that aerodynamic performance of the air inlet vent is substantially independent of an angular direction of a horizontal component of an air-stream applied to the outer surface of the overpack body.

8. The system of claim 7 wherein the air outlet vent is configured so that aerodynamic performance of the air outlet vent is substantially independent of an angular direction of a horizontal component of an air-stream applied to the outer surface of the overpack body.

9. The system of claim 8 wherein the air outlet vent comprises an annular passageway extending from an annular opening in a bottom surface of the overpack lid to an annular opening in an outer sidewall surface of the overpack lid.

10. The system of claim 1 wherein the overpack body comprises a cylindrical wall, a bottom block disposed within the cylindrical wall, and a base structure at a bottom end of the cylindrical wall, the base structure comprising a base plate and an annular plate arranged in a spaced relation to the base plate to form the annular air inlet plenum therebetween, the bottom block comprising a columnar portion that extends through a central hole of the annular plate and rests atop the base plate, the annular air inlet passageway formed within the bottom block and circumferentially surrounding the columnar portion.

11. The system of claim 1 further comprising a hermetically sealed canister for containing the high level radioactive waste positioned within the cavity, an annular gap existing between an outer surface of the canister and an inner wall surface of the overpack body, the annular gap forming an annular air flow passageway between the annular air inlet passageway and the air outlet vent.

12. The system of claim 1 wherein the annular air inlet passageway extends from a first end located a first radial distance from the vertical axis to a second end located a second radial distance from the vertical axis, wherein the second radial distance is greater than the first radial distance.

13. A system for storing high level radioactive waste comprising:

an overpack body extending along a vertical axis and having a cavity for storing high level radioactive waste, the cavity having an open top end and a floor, the overpack body comprising an air inlet vent for introducing cool air into a bottom portion of the cavity, the air inlet vent comprising a substantially horizontal annular air inlet plenum that circumferentially surrounds the vertical axis, the substantially horizontal annular air inlet plenum extending radially inward from a substantially 360° opening in an outer surface of the overpack body;

an overpack lid positioned atop the overpack body to enclose the open top end of the cavity, the overpack lid comprising an air outlet vent for removing warmed air from the cavity; and the air inlet vent configured so that aerodynamic performance of the air inlet vent is substantially independent of an angular direction of a horizontal component of an air-stream applied to the outer surface of the overpack body.

14. The system of claim 13 wherein the air outlet vent is configured so that aerodynamic performance of the air outlet vent is substantially independent of an angular direction of a horizontal component of an airstream applied to the outer surface of the overpack body.

15. The system of claim 13 wherein the air inlet vent further comprises an oblique annular air inlet passageway and the substantially horizontal annular air inlet plenum is located at an axial height below the floor, the oblique annular air inlet passageway circumferentially surrounding the vertical axis and extending upward from the substantially horizontal annular air inlet plenum to an opening in the floor.

16. A system for storing high level radioactive waste comprising:

an overpack body extending along a vertical axis and having a cavity for storing high level radioactive waste, the cavity having an open top end and a floor, the overpack body comprising an air inlet vent for introducing, cool air into a bottom portion of the cavity;

an overpack lid positioned atop the overpack body to enclose the open top end of the cavity, the overpack lid comprising an air outlet vent for removing warmed air from the cavity;

the air inlet vent configured so that aerodynamic performance of the air inlet vent is substantially independent of an angular direction of a horizontal component of an air-stream applied to the outer surface of the overpack body; and wherein the overpack body comprises a cylindrical wall, a bottom block disposed within the cylindrical wall, and a base structure at a bottom end of the cylindrical wall, the base structure comprising a base plate and an annular plate arranged in a spaced relation to the base plate to form the annular air inlet plenum therebetween, the bottom block comprising a columnar portion that extends through a central hole of the annular plate and rests atop the base plate, the annular air inlet passageway formed within the bottom block and circumferentially surrounding the columnar portion.

17. The system of claim 13 wherein the air inlet vent and the air outlet vent are substantially axisymmetric.

18. A system for storing high level radioactive waste comprising:

an overpack body extending along a vertical axis and having a cavity for storing high level radioactive waste, the cavity having an open top end and a floor, the overpack body comprising an air inlet vent for introducing cool air into a bottom portion of the cavity;

an overpack lid positioned atop the overpack body to enclose the open top end of the cavity, the overpack lid comprising an air outlet vent, for removing, warmed air from a top portion of the cavity; and the air inlet vent comprising a first section extending from an outer surface of the overpack body to a first radial distance from the vertical axis and a second section extending, from the first radial distance to an opening in the floor at a second radial distance from the vertical axis, the second radial distance being greater than the first radial distance.

19. The system of claim 18 wherein the first section of the air inlet vent is an annular plenum that extends substantially horizontal and the second section is an annular passageway that extends oblique to the vertical axis.

20. The system of claim 19 wherein the overpack body comprises a cylindrical wall, a bottom block disposed within the cylindrical wall, and a base structure at a bottom end of the cylindrical wall, the base structure comprising a base plate and an annular plate arranged in a spaced relation to the base plate to form the annular plenum therebetween, the bottom block comprising a columnar portion that extends through a central hole of the annular plate and rests atop the base plate, the annular passageway formed within the bottom block and circumferentially surrounding the columnar portion.

* * * * *